US009723964B2

(12) United States Patent
Vail

(10) Patent No.: US 9,723,964 B2
(45) Date of Patent: Aug. 8, 2017

(54) FLOOR CLEANING MACHINE

(71) Applicant: Techtronic Industries Co. Ltd., Tsuen Wan, New Territories (HK)

(72) Inventor: Kevin Vail, North Royalton, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 338 days.

(21) Appl. No.: 14/334,140

(22) Filed: Jul. 17, 2014

(65) Prior Publication Data

US 2015/0020347 A1 Jan. 22, 2015

Related U.S. Application Data

(60) Provisional application No. 61/847,623, filed on Jul. 18, 2013.

(51) Int. Cl.

| | |
|---|---|
| ***A47L 11/40*** | (2006.01) |
| ***A47L 5/30*** | (2006.01) |
| ***A47L 5/32*** | (2006.01) |
| ***A47L 7/00*** | (2006.01) |

(52) U.S. Cl.

CPC ..... *A47L 11/4016* (2013.01); *A47L 5/30* (2013.01); *A47L 5/32* (2013.01); *A47L 7/0028* (2013.01); *A47L 11/4019* (2013.01); *A47L 11/4044* (2013.01)

(58) Field of Classification Search

CPC ..... A47L 5/30; A47L 5/32; A47L 11/4044; A47L 11/4016; A47L 9/4044; A47L 7/0028

See application file for complete search history.

(56) References Cited

U.S. PATENT DOCUMENTS

| | | | | |
|---|---|---|---|---|
| 3,848,290 | A * | 11/1974 | Bates | A47L 7/0009 15/321 |
| 6,647,578 | B2 | 11/2003 | Morgan et al. | |
| 7,823,250 | B2 | 11/2010 | Vander Baan | |
| 2008/0148512 | A1* | 6/2008 | Beskow | A47L 9/04 15/350 |
| 2009/0031525 | A1* | 2/2009 | Makarov | A47L 9/1625 15/347 |

* cited by examiner

*Primary Examiner* — Robert Scruggs

(74) *Attorney, Agent, or Firm* — Michael Best & Friedrich LLP

(57) ABSTRACT

A floor cleaning machine for cleaning a floor surface includes a recovery tank having an inlet conduit and a flow divider. The flow divider includes a divider inlet in downstream fluid communication with the inlet conduit. The flow divider divides the flow into at least two separate flow paths. Each separate flow path includes a first flow path portion for directing the flow in a first direction away from the divider inlet, a second flow path portion directing the flow in a second flow direction that is substantially different from the first flow direction, and a flow redirector portion for redirecting the flow from the first flow direction to the second flow direction. The recovery tank also includes a tank body in downstream fluid communication with the flow divider. The tank body collects dirty fluid from the floor surface.

20 Claims, 5 Drawing Sheets

FLOOR CLEANING MACHINE

CROSS-REFERENCE TO RELATED APPLICATIONS

This application claims priority to U.S. Provisional Patent Application No. 61/847,623, filed Jul. 18, 2013, the entire contents of which are incorporated herein by reference.

BACKGROUND

The present invention relates to floor cleaning machines and, more particularly, to extractor floor cleaning machines.

An extractor floor cleaning machine typically sprays or otherwise distributes cleaning fluid onto a surface to wash the surface. The machine then draws the cleaning fluid and dirt from the surface into a recovery tank. Some floor cleaning machines can also deliver water to the surface to rinse the surface before and/or after the cleaning fluid is applied.

SUMMARY

In one embodiment the invention provides a floor cleaning machine for cleaning a floor surface. A frame including a foot and a handle. A suction nozzle is coupled to the foot configured to draw a flow of air and dirty fluid from the floor surface. A recovery tank is detachably coupled to the frame in fluid communication with the suction nozzle. The recovery tank includes an inlet conduit in downstream fluid communication with the suction nozzle. The recovery tank also includes a flow divider. The flow divider includes a divider inlet in downstream fluid communication with the inlet conduit. The flow divider divides the flow into at least two separate flow paths. Each separate flow path includes a first flow path portion for directing the flow in a first direction away from the divider inlet, a second flow path portion directing the flow in a second flow direction that is substantially different from the first flow direction, and a flow redirector portion for redirecting the flow from the first flow direction to the second flow direction. A tank body is supported by the frame and in downstream fluid communication with the flow divider. The tank body collects the dirty fluid. A suction source is in fluid communication with the recovery tank configured to draw the air from the tank body.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
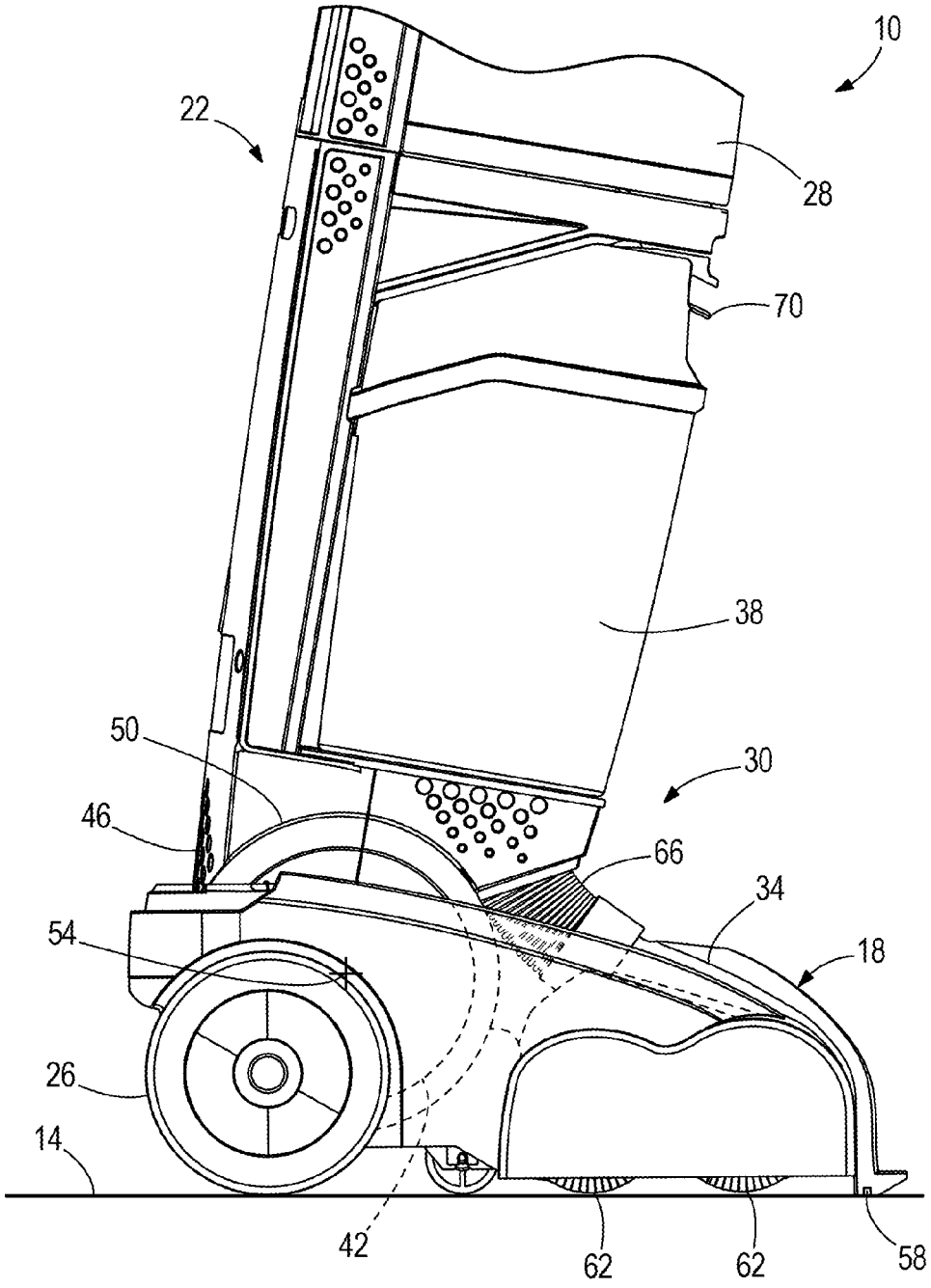
FIG. 1 is a side view of a floor cleaning machine.

FIG. 1 illustrates a floor cleaning machine, such as an extractor 10. In the illustrated embodiment, the extractor 10 is an upright extractor 10 operable to clean a surface 14, such as, for example, a hard floor surface. In some embodiments, the extractor 10 may be adapted to clean a variety of surfaces 14, such as carpets, hardwood floors, tiles, or the like. The extractor 10 distributes or sprays cleaning fluid onto the surface 14 to clean the surface 14. As used herein, "cleaning fluid" refers to a detergent, a sanitizer, a mixture of water and detergent/sanitizer, or plain water. The extractor 10 then draws, or recovers, relatively dirty fluid from the surface 14, leaving the surface 14 relatively clean and dry.

The extractor 10 includes a frame configured as a base or foot 18 and a handle assembly 22. The handle assembly 22 is pivotably coupled to the foot 18. The foot 18 includes wheels 26 to facilitate movement of the foot 18 along the surface 14. In the illustrated embodiment, the wheels 26 are non-powered wheels 26. In other embodiments, however, any of the wheels 26 may be driven. The handle 22 extends from the foot 18 and is pivotable between a substantially upright storage position (as illustrated in FIG. 1) and a reclined operating position (not shown). Pivoting the handle 22 to a reclined operating position facilitates moving (e.g., pushing and pulling) the foot 18 along the surface 14.

The extractor 10 includes a supply tank assembly 28 coupled to the handle 22 and a distribution nozzle that directs cleaning solution from the supply tank assembly 28 onto the surface 14. The supply tank assembly 28 is removable from the extractor handle 22 and may include a handle to facilitate transport and handling of the supply tank assembly 28 apart from the extractor handle 22. The supply tank assembly 28 may include one or more supply tanks, each of which defining a discrete volume for separately storing one or more cleaning solutions and/or water. For example, a first supply tank may store a detergent, a second supply tank may store a sanitizer, and a third supply tank may store water. Each of the supply tanks may include an outlet that communicates with a distributor for drawing the corresponding fluid from the supply tanks, mixing the fluids, and directing the mixed fluids to the distribution nozzle. The outlets of the supply tanks may also be used to refill the supply tanks when the supply tank assembly 28 is removed from the handle 22. Alternatively, the tanks may be filled through separate filling ports that are covered by separate caps.

With reference to FIG. 1, the extractor 10 also includes a suction system 30, including a suction nozzle 34, a recovery tank 38, and a suction motor assembly 42 in sequential fluid communication. More specifically, the suction motor assembly 42 is in fluid communication with the suction nozzle 34 and recovery tank 38 for drawing fluid and dirt from the surface 14 being cleaned, through the suction nozzle 34, and into the recovery tank 38. Relatively clean, dry air is then drawn out of the recovery tank 38, through the suction motor assembly 42, and discharged through an air outlet 46.

In some embodiments, the suction motor assembly 42 includes a fan or impeller that generates a vacuum to draw the fluid and dirt through the suction nozzle 34. In the illustrated embodiment, the suction motor assembly 42 is supported by and positioned within a motor housing portion 50 of the handle 22. The motor housing portion 50 includes a substantially cylindrical profile centered about a pivot axis 54 between the handle 22 and the foot 18. Alternatively, a central axis of the motor housing portion 50 and the pivot axis 54 between the handle 22 and the foot 18 may be offset.

The suction nozzle 34 is supported by a front portion of the foot 18 and includes a downward-facing inlet 58 adjacent the surface 14 to be cleaned. In the illustrated embodiment, rotary brushes 62 are supported on the lower surface of the foot 18 adjacent the suction nozzle. The brushes 62 may be electrically- or pneumatically-actuated.

The recovery tank 38 is disposed on the handle 22 and is connected to the suction nozzle 34 via a flexible conduit 66. The recovery tank 38 temporarily stores dirty fluid drawn up from the surface 14 through the suction nozzle 34. The recovery tank 38 may be removed from the handle 22 by actuating a latch mechanism 70 (FIGS. 1-4).

Figure 2:
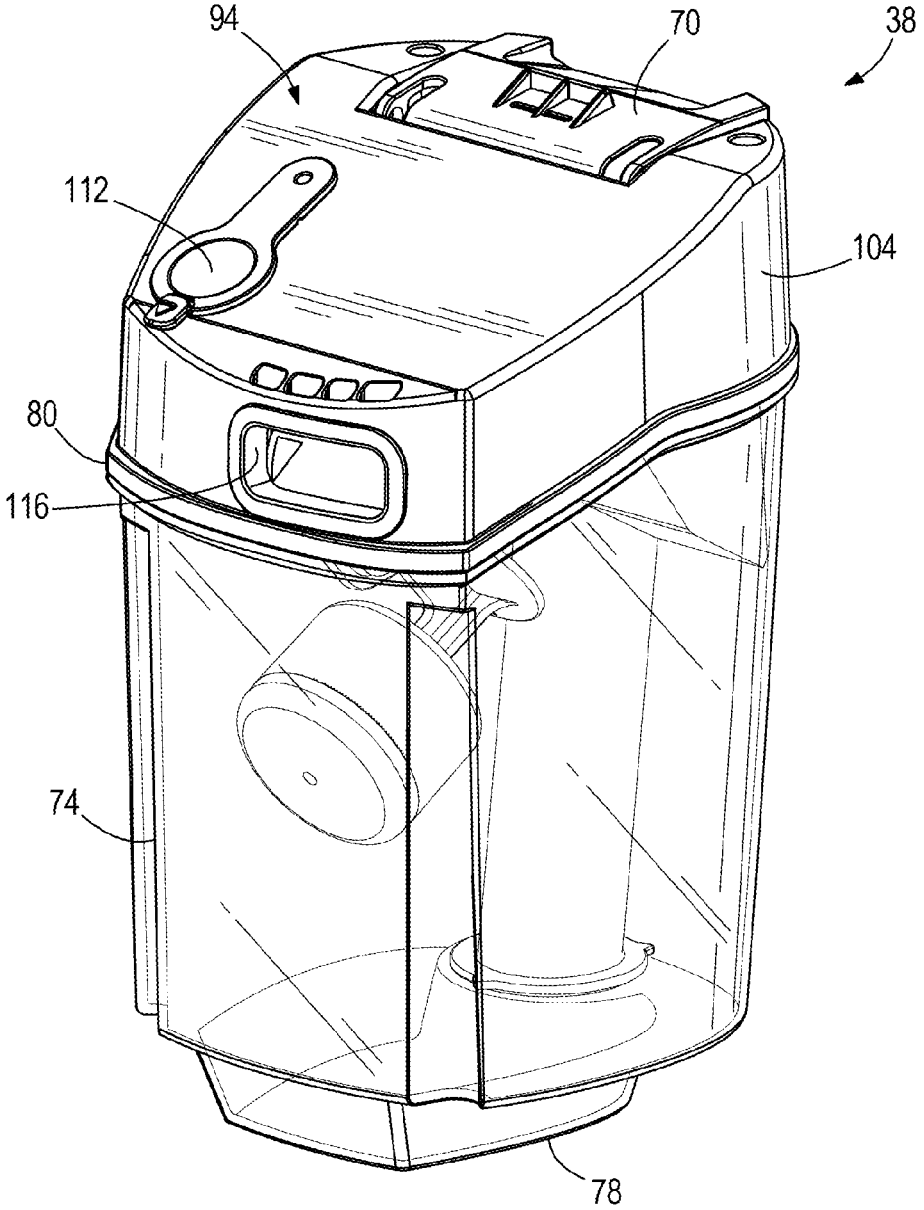
FIG. 2 is a perspective view of a recovery tank of the floor cleaning machine of FIG. 1.
Figure 3:
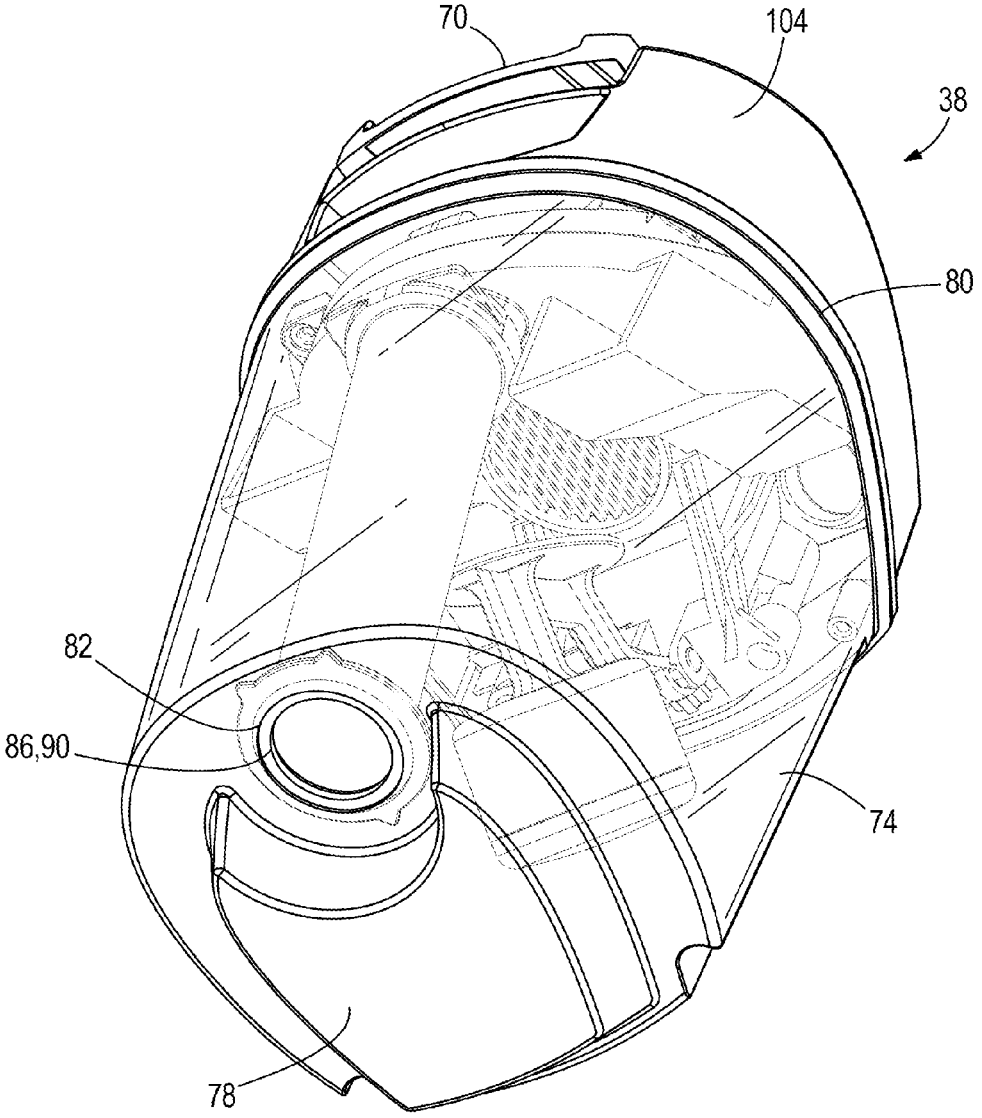
FIG. 3 is another perspective view of the recovery tank of FIG. 2.

Referring to FIG. 2, the recovery tank 38 includes a tank body 74 extending from a base end 78 to a cover end 80. The recovery tank includes a cover 104 coupled to the tank body 74 by ultrasonic welding, for example, to form an enclosed cavity. Referring to FIG. 3, the base end 78 defines an inlet aperture 82. An inlet conduit 86 extends through the tank body 74 and includes an upstream end 90 coupled to the inlet aperture 82. When the recovery tank 38 is coupled to the handle 22, as in FIG. 1, the inlet conduit 86 receives the air and dirty fluid mixture from the suction nozzle 34, via the flexible conduit 66.

Figure 4:
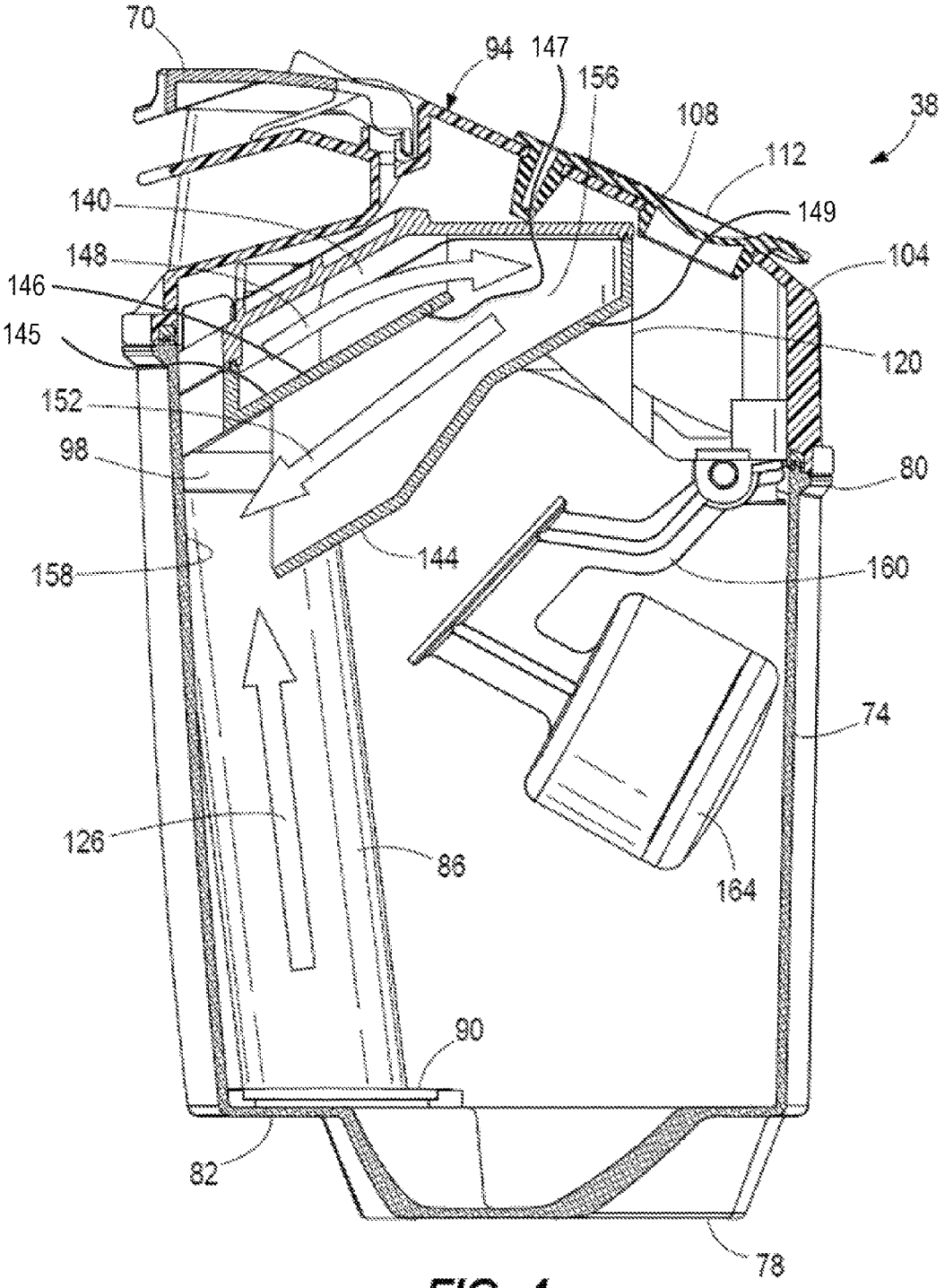
FIG. 4 is a cross-sectional view of the recovery tank of FIG. 2, illustrating a fluid flow path through the recovery tank.

Referring to FIG. 4, the cover 104 includes a separator assembly 94 that is coupled to a downstream end 98 of the inlet conduit 86. The cover 104 defines a drain aperture 108 for draining recovered fluid from the tank body 74 when the recovery tank 38 is at least partially inverted. The drain aperture 108 is selectively closed off by a cap member 112 that is coupled to the cover 104. Referring to FIG. 2, the cover 104 further defines a tank air outlet 116. When the recovery tank 38 is coupled to the handle 22, as in FIG. 1, the tank air outlet 116 is in fluid communication with the suction motor assembly 42 and provides an outlet for relatively clean, dry air to exit the recovery tank 38.

Figure 5:
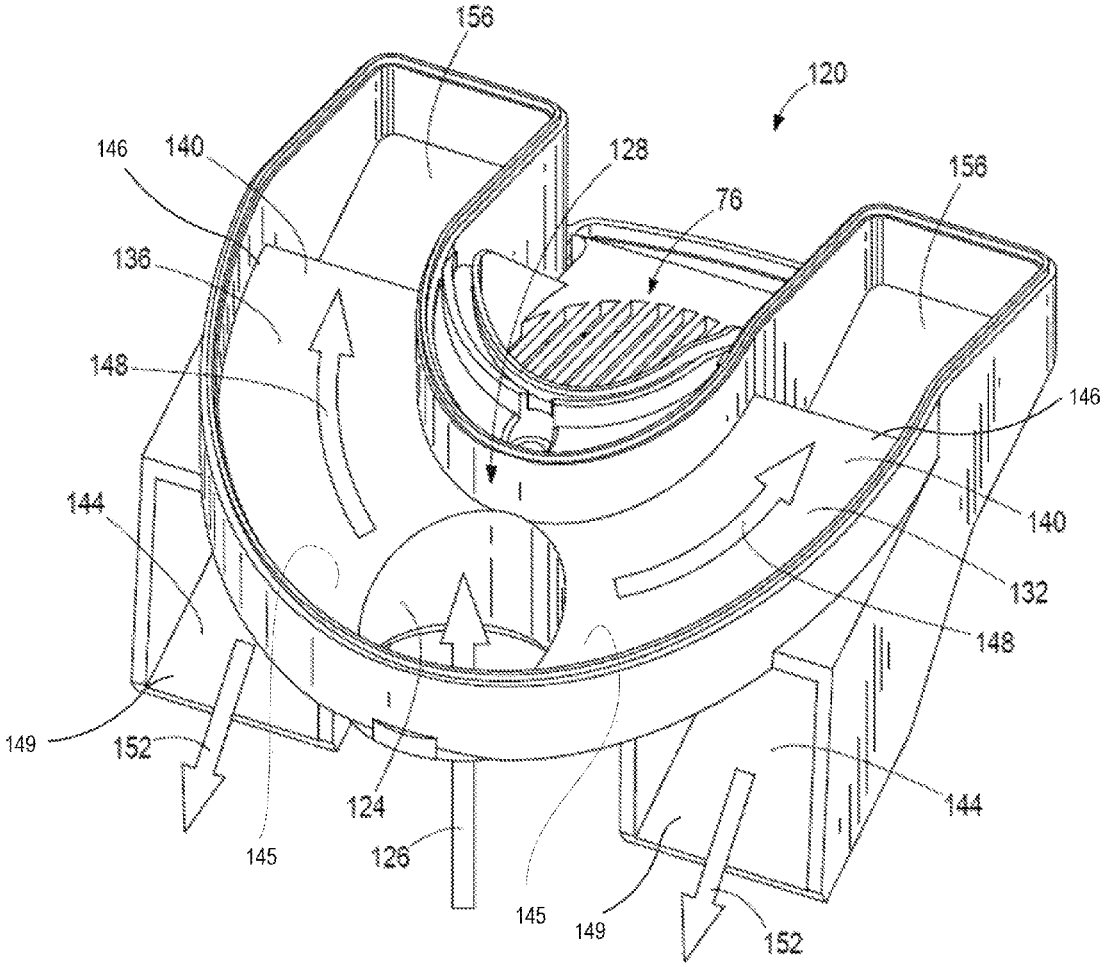
FIG. 5 is a perspective view of a flow divider of the recovery tank of FIG. 2.

Referring to FIGS. 4 and 5, the separator assembly 94 further includes a flow divider 120. The flow divider 120 is coupled to the downstream end 98 of inlet conduit 86 for receiving the air and dirty fluid mixture from the suction nozzle 34 (FIG. 1). Referring to FIG. 5, the air and dirty fluid mixture enters the flow divider 120 at a divider inlet 124 along an inlet direction 126. From the divider inlet 124, the fluid flow is split in a y-shaped junction 128 into two separate flow paths 132 and 136. The cross-sectional flow area of the y-shaped junction 128, as well as the total cross-sectional flow area of the flow paths 132 and 136, is greater than the cross-sectional area of the inlet conduit 86 (FIG. 4). The increase in flow area slows the dirty fluid and air mixture to begin separating the air from the entrained dirty fluid.

Referring to FIG. 5, each of the separate flow paths 132 and 136 includes a first flow path portion 140 and a second flow path portion 144. With reference to FIGS. 4 and 5, the illustrated first flow path portion 140 is at least partially defined by an upper surface 145 of a first wall 146 of the flow divider 120 so that the first flow path portion 140 directs flow upwardly and rearwardly in a first direction 148. The illustrated second flow path portion 144 is at least partially defined between a lower surface 147 of the first wall 146 and a second wall 149 of the flow divider 120 so that the second flow path portion 144 directs the flow downwardly and forwardly in a second direction 152 that is substantially opposite the first direction 148. The second wall 149 is positioned below the first wall 146 (FIG. 4). A flow redirector portion 156 between the first flow path portion 140 and the second flow path portion 144 redirects the air and dirty fluid mixture from the first direction 148 to the second direction 152. In the illustrated embodiment, the first direction 148 is substantially in a reverse direction relative to the second direction 152. In other words, the first direction 148 is orientated at about a 180 degree angle relative to the second direction 152. In other embodiments, the flow redirector portion 156 may not completely reverse the second direction 152 relative to the first direction 148. Rapid deceleration and direction change within the flow redirector portion 156 causes additional separation of the entrained dirty fluid from the air.

Downstream of the second flow path portion 144, the air and dirty fluid exit the flow divider 120 and impinge upon an impingement region 158 of the tank body 74. The impingement region 158 again rapidly slows the dirty fluid, resulting in further separation from the air. The dirty fluid collects in the tank body 74, while the relatively clean, relatively dry air exits the recovery tank 38 through the tank air outlet 116 via an air exit path 76 extending vertically upwardly between the first fluid path portions 140.

A float check valve 160 is pivotally coupled to the separator assembly 94, more specifically the flow divider 120. The float check valve 160 selectively obstructs the air exit path 76 when a level of the dirty fluid reaches a float portion 164 (FIG. 4) of the float check valve 160. Buoyancy of the float portion 164 causes the float check valve to rotate to a position that substantially obstructs the dirty fluid from exiting the recovery tank 38 through the air exit path 76.

The recovery tank 38, and in particular the separator assembly 94 including the flow divider 120, provide for improved separation of air from dirty fluid.

The configuration of the separator assembly 94 within the cover 104 also inhibits any recovered liquid from unintentionally exiting the recovery tank 38 during use of the extractor 10 and during emptying of the recovery tank 38 after the extractor 10 has been turned off and the recovery tank 38 has been removed for emptying. During operation of the extractor 10, the recovery tank 38 is coupled to the handle 22 and therefore pivots with the handle 22 relative to its vertical orientation (shown in FIG. 4). As the handle 22 is pivoted rearwardly relative to the foot 18, the recovery tank 38 also pivots rearwardly thereby sloshing the recovered fluid within the recovery tank 38. The second flow path portions 144 block the sloshing fluid from entering the first flow path portion 140. The blocking of the sloshing liquid is especially important to inhibit recovered fluid from backflowing into the inlet conduit 86 when the handle is pivoted to move the extractor 10 and the suction motor is turned off. In addition, when the recovery tank 38 is removed from the extractor 10 to pour the recovered liquid from the drain aperture 108, the second flow path portion, which opens in a direction away from the drain aperture 108, inhibits the sloshing recovered liquid from re-entering the first flow path portions and the inlet conduit 86.

Thus, the invention provides, among other things, a floor cleaning machine. Various features and advantages of the invention are set forth in the following claims.

What is claimed is:

1. A floor cleaning machine for cleaning a floor surface, comprising:

a frame including a foot and a handle;

a suction nozzle coupled to the foot configured to draw a flow of air and dirty fluid from the floor surface;

a recovery tank detachably coupled to the frame in fluid communication with the suction nozzle, the recovery tank including, an inlet conduit in downstream fluid communication with the suction nozzle, a flow divider including a divider inlet in downstream fluid communication with the inlet conduit, the flow divider dividing the flow into at least two separate flow paths, each separate flow path including a first flow path portion for directing the flow in a first flow direction away from the divider inlet, a second flow path portion directing the flow in a second flow direction that is substantially opposite from the first flow direction, and a flow redirector portion for redirecting the flow from the first flow direction to the second flow direction, and a tank body supported by the frame and in downstream fluid communication with the flow divider, the tank body collecting the dirty fluid; and a suction source in fluid communication with the recovery tank configured to draw the air from the tank body.

2. The floor cleaning machine of claim 1, wherein the flow divider further includes a y-shaped junction in downstream fluid communication with the divider inlet, the y-shaped junction dividing the flow into the at least two separate flow paths.

3. The floor cleaning machine of claim 2, wherein a cross-sectional flow area of the y-shaped junction is greater than a cross-sectional flow area of the inlet conduit which is configured to initiate separation of the air from the dirty fluid.

4. The floor cleaning machine of claim 1, wherein the inlet conduit extends through the tank body.

5. The floor cleaning machine of claim 1, wherein the inlet conduit extends between a base end of the tank body and the divider inlet.

6. The floor cleaning machine of claim 1, further comprising a cover substantially enclosing the tank body.

7. The floor cleaning machine of claim 6, wherein the cover defines a tank air outlet in fluid communication with the suction source.

8. The floor cleaning machine of claim 6, wherein the cover defines a drain aperture for draining dirty fluid from the tank body.

9. The floor cleaning machine of claim 8, wherein the second flow path portion opens in a direction away from the drain aperture which is configured to prevent dirty fluid from backflowing into the second flow path portion.

10. The floor cleaning machine of claim 6, wherein the cover includes a separator assembly wherein a float check valve is coupled to the separator assembly, the float check valve substantially fluidly obstructing the tank air outlet when dirty fluid within the tank body reaches a pre-defined level.

11. The floor cleaning machine of claim 10, wherein the separator assembly includes the flow divider wherein the float check valve is pivotally coupled to the flow divider.

12. The floor cleaning machine of claim 1, wherein the recovery tank further comprises a latch mechanism for selectively latching the recovery tank to the frame.

13. The floor cleaning machine of claim 1, further comprising a flexible conduit extending between the foot and the handle, the flexible conduit in fluid communication with the suction nozzle and the inlet conduit.

14. The floor cleaning machine of claim 13, wherein the flexible conduit is externally visible between the foot and the handle.

15. The floor cleaning machine of claim 1, wherein the first flow direction generally flows upwardly within the flow diverter.

16. The floor cleaning machine of claim 1, wherein the second flow direction generally flows downwardly within the flow diverter.

17. The floor cleaning machine of claim 1, wherein downstream of the second flow path portion the second flow direction diverts off of an impingement region of the tank body.

18. The floor cleaning machine of claim 1, wherein the recovery tank includes an air exit path extending substantially vertically between the first fluid path portion.

19. The floor cleaning machine of claim 18, wherein the air exit path is in fluid communication with the tank air outlet.

20. The floor cleaning machine of claim 1, wherein the flow divider includes a first wall having an upper surface at least partially defining the first flow path portion and a lower surface, and wherein the flow divider also includes a second wall positioned below the first wall, and wherein the second flow path portion is at least partially defined between the lower surface of the first wall and the second wall.

* * * * *